US008979681B1

(12) United States Patent
Murphy et al.

(10) Patent No.: US 8,979,681 B1
(45) Date of Patent: Mar. 17, 2015

(54) METHODS AND APPARATUS FOR BATTING TEE HAVING RAPID RETURN

(71) Applicants: Joseph T. Murphy, Winthrop, MA (US); Christopher S. Beshere, Winthrop, MA (US); William E. Rullo, Jr., Carver, MA (US)

(72) Inventors: Joseph T. Murphy, Winthrop, MA (US); Christopher S. Beshere, Winthrop, MA (US); William E. Rullo, Jr., Carver, MA (US)

(73) Assignee: Promounds, Inc., Brockton, MA (US)

( * ) Notice: Subject to any disclaimer, the term of this patent is extended or adjusted under 35 U.S.C. 154(b) by 12 days.

(21) Appl. No.: 13/766,289

(22) Filed: Feb. 13, 2013

(51) Int. Cl.
*A63B 71/00* (2006.01)
*A63B 69/00* (2006.01)

(52) U.S. Cl.
CPC ..... *A63B 69/0075* (2013.01); *A63B 69/00* (2013.01); *A63B 69/0002* (2013.01); *A63B 2069/0008* (2013.01); *A63B 2225/093* (2013.01)
USPC ..... 473/417; 473/451

(58) Field of Classification Search
CPC ..... A63B 69/00; A63B 69/00002; A63B 69/0075; A63B 2069/0008; A63B 2225/093
USPC ..... 473/417, 422, 451, 423–429, 444; D21/662; 482/85–87, 89, 90
See application file for complete search history.

(56) References Cited

U.S. PATENT DOCUMENTS

| | | | | |
|---|---|---|---|---|
| 2,272,765 | A * | 2/1942 | Beeson et al. | 473/417 |
| 2,616,692 | A * | 11/1952 | Bird | 473/417 |
| 3,183,000 | A * | 5/1965 | Dix | 473/417 |
| 3,874,662 | A * | 4/1975 | Harrington | 473/417 |
| 4,059,934 | A | 11/1977 | Hayamizu | |
| 4,133,154 | A | 1/1979 | Ruzicka | |
| 4,176,838 | A | 12/1979 | Griffin | |
| 4,364,563 | A * | 12/1982 | Stafford | 473/417 |
| 4,381,110 | A | 4/1983 | Balaz | |
| 4,489,941 | A | 12/1984 | Shieh | |
| 4,938,478 | A | 7/1990 | Lay | |
| 4,993,708 | A * | 2/1991 | Prossor et al. | 473/417 |
| 5,029,852 | A | 7/1991 | Gilfillan | |
| 5,118,103 | A | 6/1992 | Miller | |
| 5,393,050 | A * | 2/1995 | Lloyd | 473/429 |
| 5,415,396 | A * | 5/1995 | Huang | 473/417 |
| 5,582,403 | A | 12/1996 | George | |
| 5,722,905 | A | 3/1998 | Bidelman | |
| 5,772,536 | A * | 6/1998 | Wang | 473/417 |

(Continued)

FOREIGN PATENT DOCUMENTS

| | | | |
|---|---|---|---|
| DE | 3232323 A1 * | 3/1984 | A63B 69/34 |
| WO | WO00/59586 | 10/2000 | |

OTHER PUBLICATIONS

Spring Away Batting Tee, Heater Sports, 2008. Taken from the Internet on Nov. 2, 2012 from http://heatersports.com/product_details.php?id=SAEZ1999&c=Batting%20Tees, 2 pages.

(Continued)

*Primary Examiner* — Mitra Aryanpour
(74) *Attorney, Agent, or Firm* — Daly, Crowley, Mofford & Durkee, LLP

(57) ABSTRACT

Methods and apparatus for a batting tee having a base removably matable to a post that includes a pivot mechanism including a pivot point located between axially aligned first and second springs connected to a cable extending along a coincident longitudinal axis of the first and second springs. The pivot point allows the post to rotate at the pivot point in response to an impact on the ball holder and/or post. The springs force the post back to an upright position.

18 Claims, 7 Drawing Sheets

(56) References Cited

U.S. PATENT DOCUMENTS

| | | | | |
|---|---|---|---|---|
| 5,848,945 | A | 12/1998 | Miller et al. | |
| 6,045,462 | A * | 4/2000 | Mourek | 473/417 |
| 6,146,289 | A | 11/2000 | Miller et al. | |
| 6,257,307 | B1 | 7/2001 | Tollivar | |
| 6,398,671 | B1 | 6/2002 | Rios | |
| 6,402,632 | B2 | 6/2002 | Hope et al. | |
| 6,672,979 | B2 | 1/2004 | Brenneisen | |
| 7,354,360 | B1 | 4/2008 | Eckstein | |
| 7,704,168 | B1 | 4/2010 | Hochberg | |
| 7,762,515 | B2 | 7/2010 | Lin | |
| 8,029,389 | B2 * | 10/2011 | Chiu | 473/417 |
| 8,162,780 | B2 * | 4/2012 | Wang | 473/417 |
| 8,246,493 | B1 * | 8/2012 | Ling | 473/417 |
| 8,279,032 | B1 | 10/2012 | Fullerton et al. | |
| 8,393,980 | B2 * | 3/2013 | Chen | 473/417 |
| 2005/0003908 | A1 | 1/2005 | Smull et al. | |
| 2007/0049428 | A1 | 3/2007 | Stromsborg | |
| 2010/0304900 | A1 | 12/2010 | Gu | |
| 2010/0311524 | A1 * | 12/2010 | Lay | 473/417 |
| 2011/0165969 | A1 | 7/2011 | Gu | |
| 2011/0195804 | A1 | 8/2011 | Hixon et al. | |
| 2012/0229241 | A1 | 9/2012 | Fullerton et al. | |
| 2012/0302381 | A1 | 11/2012 | Lay | |

OTHER PUBLICATIONS

Eli's Springback Tee, http://elispringbacktee.com/, Oct. 31, 2012, 1 page.

Springback Tee, http://www.ondecksports.com/Springback-Tee?sc=12&category=1917, Oct. 31, 2012, 2 pages.

The G Tee High Quality Baseball Batting TEE by G TEE, http://www.amazon.com/Quality-Baseball-Batting-TEE-Adjustable/dp/B005KWBK5M, Oct. 31, 2012, 3 pages.

Tanner Tee, Joe H. Tanner Baseball Products, LLC, http://www.tannertees.com/batting-tee-features, Oct. 31, 2012, 1 page.

The Tanner Training Tee, http://www.betterbaseball.com/browse/cfm/the-tanner-training-tee/4.4506.html, Oct. 31, 2012, 1 page.

It's G Time, http://thegtee.com/, Oct. 31, 2012, 1 page.

Product Information::The G Tee, http://thegtee.com/product-info.php, Oct. 31, 2012, 1 page.

* cited by examiner

METHODS AND APPARATUS FOR BATTING TEE HAVING RAPID RETURN

BACKGROUND

As is known in the art, baseball and softball players often use a batting tee to practice hitting a ball. The batter places the ball on the tee and takes a practice swing to strike the ball. Some conventional batting tees include posts of a relatively rigid material that tend to deform, e.g., bend, over time due to contact with a bat, and thus, have limited durability. In addition, these tees can damage a bat striking the post in the case of a miss hit. These types of tees also tend to tip over when the bat strikes the post.

Another known type of tee 10 is shown in FIG. 1. The tee 10 includes a rigid post 12 with a ball holder 14 at one end and a spring 16 at the other end. The spring 16 is secured to a base 18. In the case of a miss hit of the ball, the bat can strike the post 12 causing the spring 16 to flex. However, the post continues to move back and forth for a significant length of time, such as in the order of minutes. The batter must grab the post and steady it before placing another ball on the holder 14.

It should be noted that the spring is not used in the manner in which springs are fabricated to operate. That is, springs are made for compression and extension along a longitudinal axis. While a spring will flex about a point along its axis, the spring is not compressed in an axial manner as intended. In addition, the spring requires a significant amount of time to return to its quiescent state. That is, the spring continues to bounce back and forth about the pivot point.

SUMMARY

In one aspect of the invention, a batting tee comprises: a ball holder, a post having first and second ends, the ball holder connected to the first end of the post, and a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder and/or post.

The tee can further include one or more of the following features: a magnet to secure the post to the base, the first spring comprises a compression spring, a first spring barrier coupled to the cable to contain the first spring in a first cavity and a second spring barrier coupled to the cable to contain the second spring in a second cavity, the first spring barrier comprises a washer, a first clamp secured to the cable proximate the first spring barrier and a second clamp secured to the cable proximate the second spring barrier, the pivot mechanism comprises a connector shaped to increase a distance between the first and second cavities as the post flexes at the pivot point, the connector is shaped to prevent the post from being locked in a flexed position, the connector comprises a groove to prevent the post from being locked in the flexed position, and/or a magnet contained in the post and a ferromagnetic material in the base to removably secure the post to the base.

In another aspect of the invention, a batting tee comprises: a post having first and second ends, the ball holder connected to the first end of the post, a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder and/or post, and a magnet proximate the second end of the post to secure the post to the base.

The tee can further include one or more of the following features: the first spring comprises a compression spring, a first spring barrier coupled to the cable to contain the first spring in a first cavity and a second spring barrier coupled to the cable to contain the second spring in a second cavity, the pivot mechanism comprises a connector shaped to increase a distance between the first and second cavities as the post flexes at the pivot point, the pivot point mechanism comprises a connector that includes a groove to prevent the post from being locked in the flexed position, and/or a ferromagnetic material in the base to removably secure the post to the base.

In a further aspect of the invention, a method comprises: providing a post having first and second ends, connecting a ball holder to the first end of the post, and providing a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder and/or post. The method can further include one or more of: providing a magnet to secure the post to the base, coupling a first spring barrier to the cable for containing the first spring in a first cavity and coupling a second spring barrier to the cable for containing the second spring in a second cavity, and/or the pivot mechanism includes a connector with a groove to prevent the post from being locked in the flexed position.

BRIEF DESCRIPTION OF THE DRAWINGS

The foregoing features of this invention, as well as the invention itself, may be more fully understood from the following description of the drawings in which.

DETAILED DESCRIPTION

Figure 1:
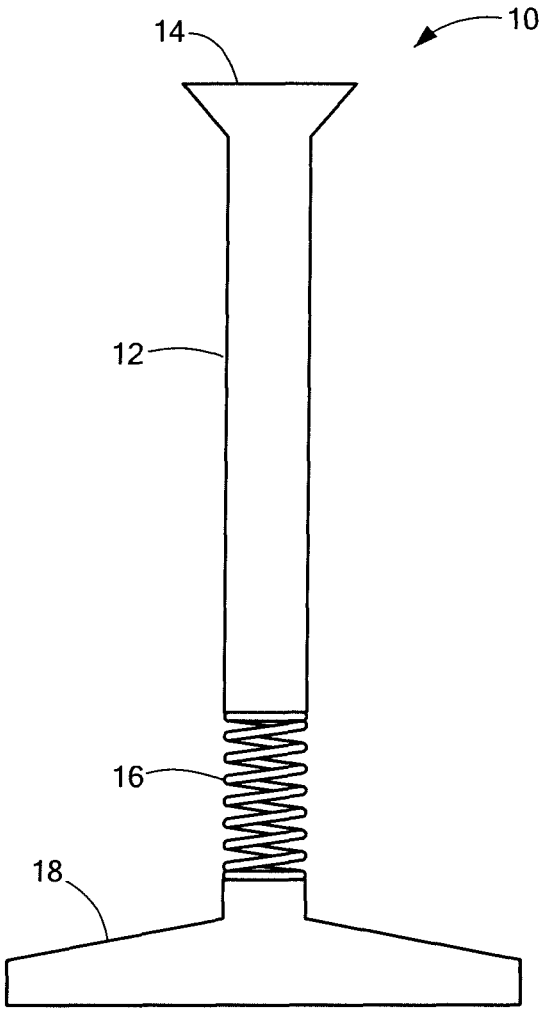
FIG. 1 PRIOR ART
FIG. 1 is a schematic representation of a prior art batting tee.
Figure 2:
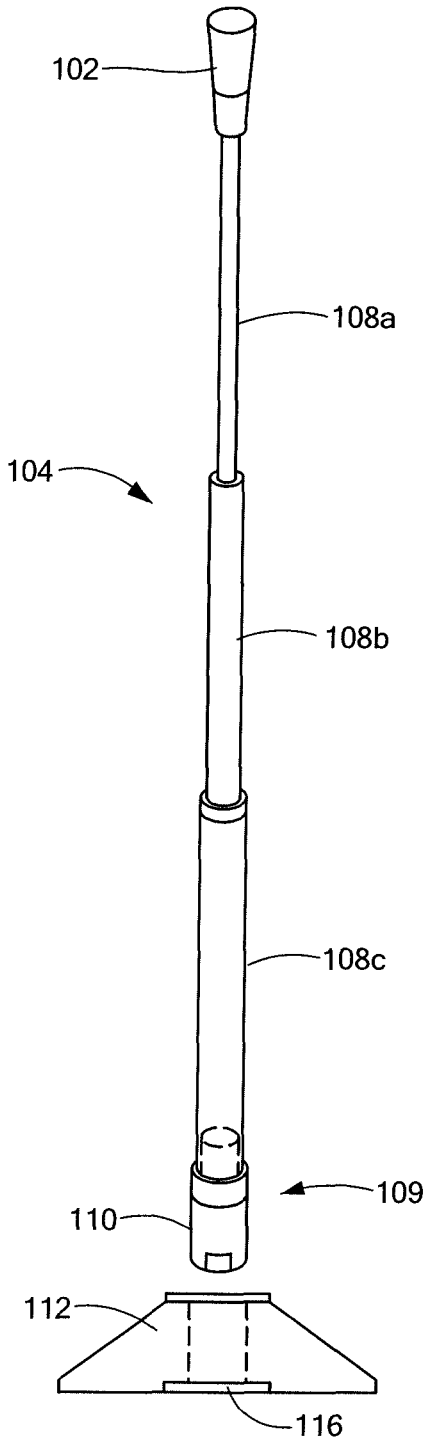
FIG. 2 is a schematic representation of a batting tee in accordance with exemplary embodiments of the invention.

FIG. 2 shows a batting tee 100 having a ball holder 102 at one end of a telescoping post 104 removably secured to a base 106. In one embodiment, tubing sections 108*a, b, c* having diameters to provide a telescoping configuration. A first tubing section 108*a*, fits into a second tubing section 108*b*, which fits into a third telescoping section 108*c*.

A pivot point 109 is located between first and second springs (FIG. 3), as described more fully below. When a batter strikes the ball holder 102 or post 104, the portion of the post about the pivot point 108 moves, such as rotating down to the ground. Upon rotating, or hitting the ground, the post 104 quickly returns, e.g., in the order of a few seconds, to a stable, vertical position. The batter can then place another ball on the holder and continue practicing.

A bottom of the post 104 includes a post connector 110 for mating with a base connector 112 forming a part of the base 106. In an exemplary embodiment, the post connector 110 includes a magnet 114 and base connector 112 includes a ferrous metallic material 116. The post connector 110 can be readily inserted into the base connector 112. The magnet 114 retains the post connector 110 in the base connector 112 during rotation of the post in response to contact with a bat.

Figure 3:
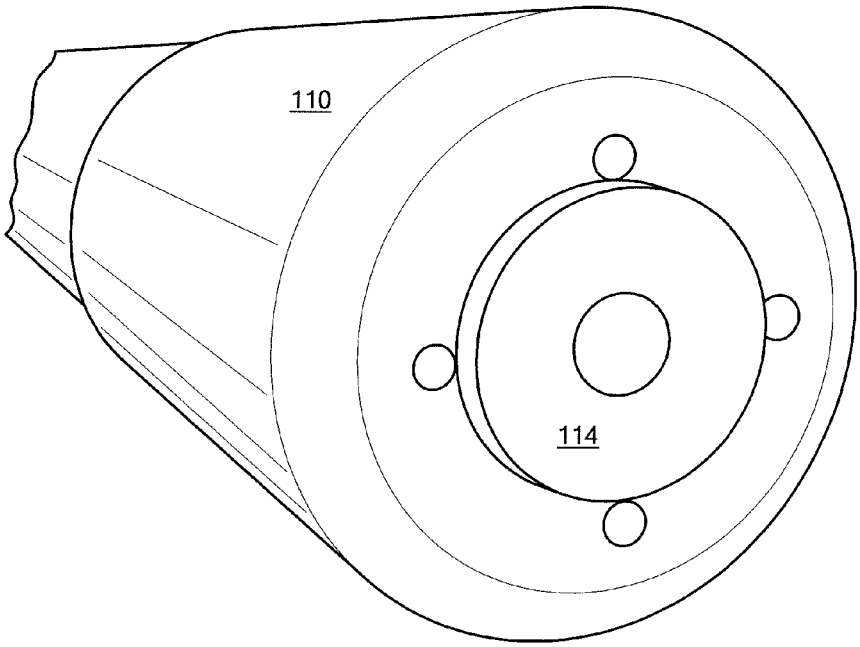
FIG. 3 is a pictorial representation of an end of a post having a magnet.

FIG. 3 shows an exemplary magnet 114 secured at one end of the post connector 110. It is understood that the magnetic can have any practical geometry to meet the needs of a particular application. In the illustrated embodiment, the magnet 114 has a cylindrical shape. It is further understood that any suitable magnetic material can be used. In one embodiment, the magnet comprises an earth magnet. In other embodiments, more than one magnetic is used. In another embodiment, a ring magnet is used. The strength of the magnet can be selected to meet the needs of a particular application. For example, a tee ball tee can have a magnet that is weaker than a magnet in a college level baseball tee. The magnet should be of sufficient flux density so as to enable removal of the post connector from the base connector with a reasonable pull strength that also maintains the integrity of the tee during use. The post and base connectors can also have an interference fit.

Figure 4A:
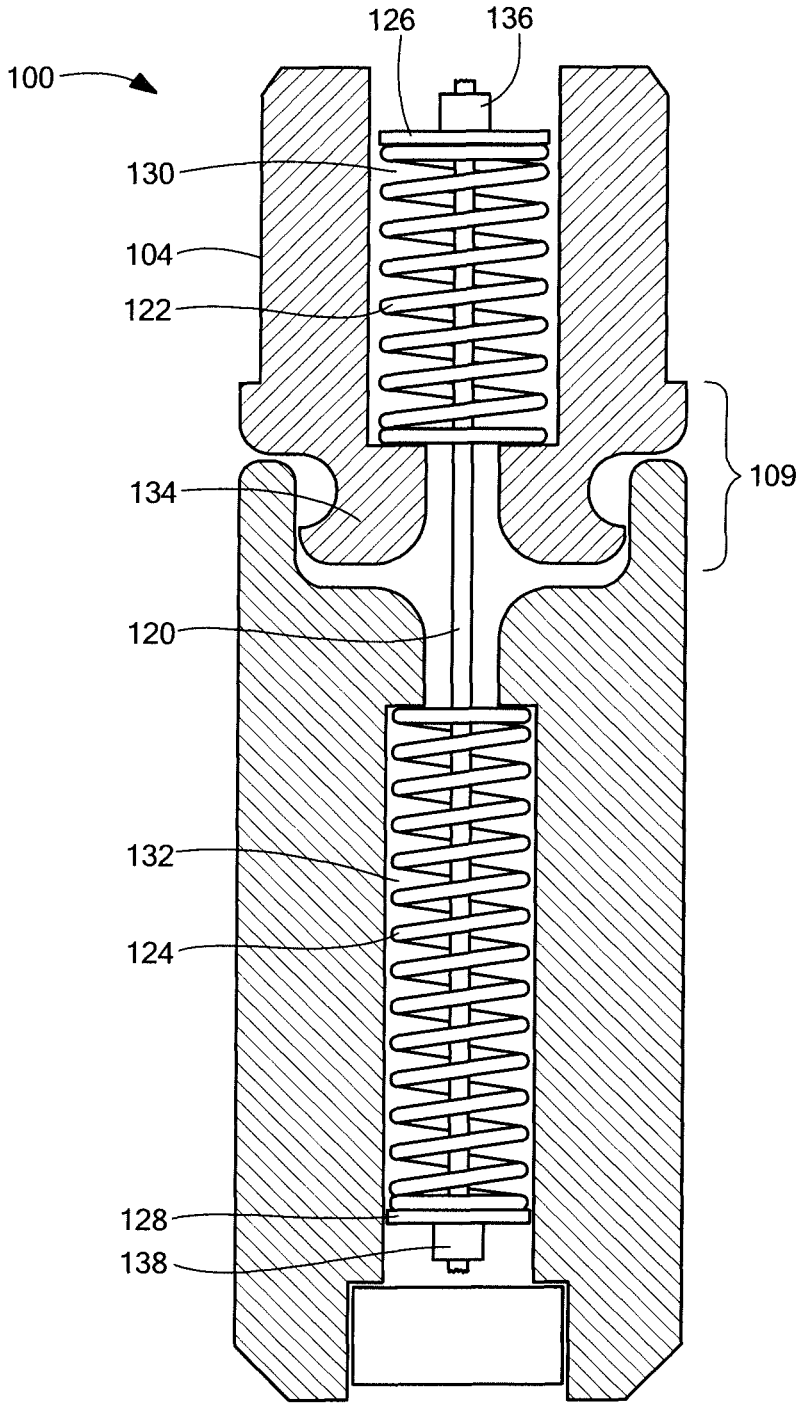
FIG. 4A is a schematic representation of a pivot point of a batting tee in an upright position.
Figure 4B:
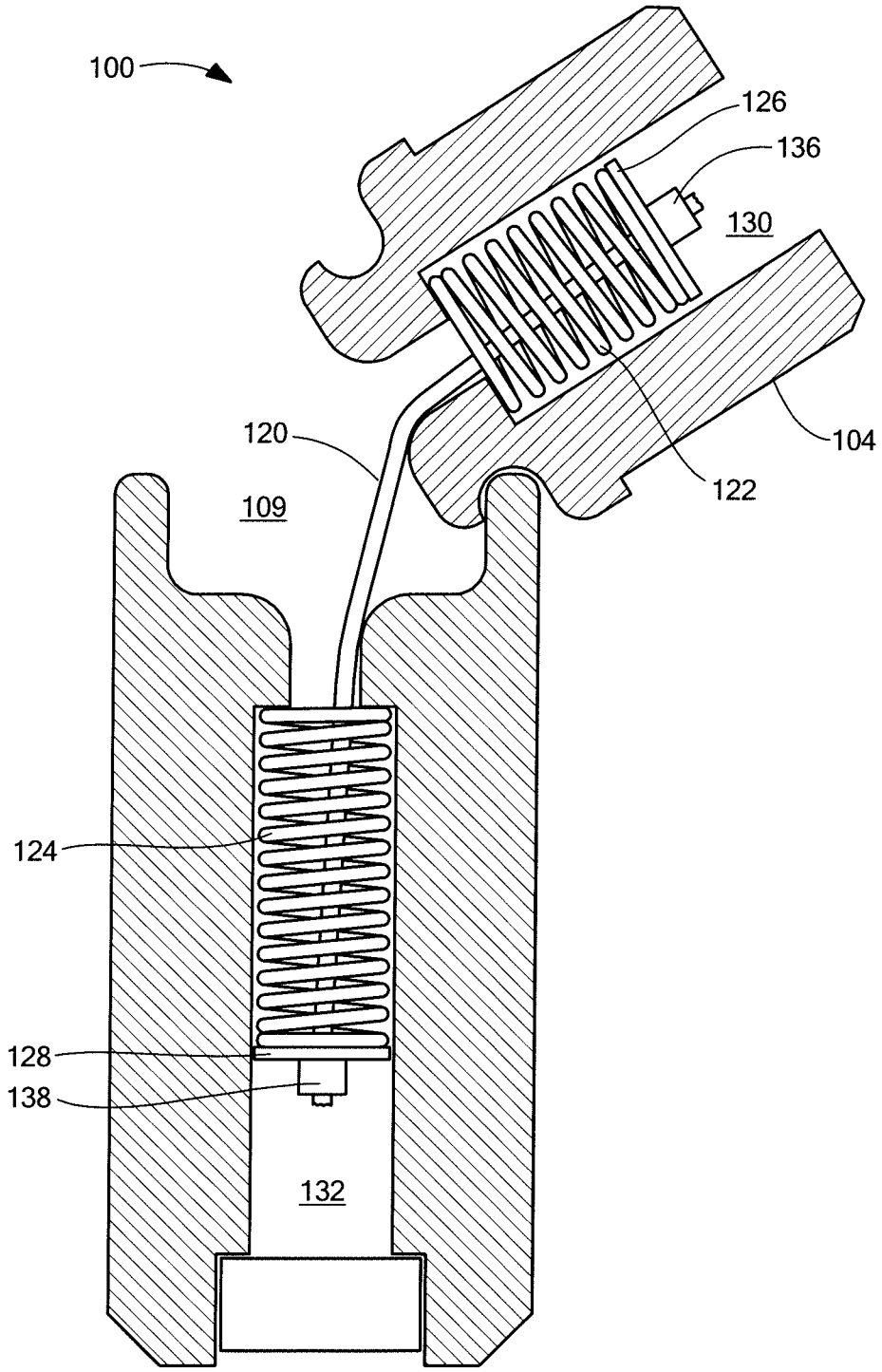
FIG. 4B is a schematic representation of a pivot point of a batting tee in a flexed position.

FIGS. 4A and 4B show additional detail for the pivot point 109 of the tee. FIG. 4A shows the tee 100 in an upright position and FIG. 4B shows the tee having the pivot point 109 flexed, such as after being struck by a bat, but before return to the upright position. A cable 120 extends along an axis of first and second springs 122, 124. A first spring barrier 126, such as a washer, is secured to the cable 120 at a top of the first spring 122 and a second spring barrier 128, such as a washer, is secured to the cable at a bottom of the second spring 124. The first spring 122 in located in a first cavity 130 and the second spring is located in a second cavity 132. A pivot connector 134 prevents the post from becoming locked in the horizontal position, as described more fully below. A first clamp 136 adjacent to the first washer 126 is secured to the cable 120 and a second clamp 138 is secured to the cable adjacent to the second washer 128. The length of cable 120 between the first and second clamps 136, 138 remains fixed in the upright and flexed positions.

In an exemplary embodiment, the first and second springs 122, 124 are under compression in the upright position. When the tee is struck by a bat, the pivot point 109 allows the post 104 to move to the ground, for example. Upon rotation of the post 104 at the pivot point 109, the amount of compression in the first and second springs 122, 124 is increased as the cable pulls the first and second spring barriers 126, 128, such as washers. As can be seen, as the post flexes, the first washer 126 pulls down on the first spring 122 to further compress the first spring in the first cavity, and the second washer 128 pulls up on the second spring 124 to compress the second spring in the second cavity 132. As the post 104 flexes, the pivot connector 134 increases the distance between the first and second cavities 130, 132 thereby compressing the first and second springs 122, 124 in their respective cavities 130, 132. The springs 122, 124 resist the additional compression and push the post back to a vertical orientation.

It is understood that the terms "spring barrier" and exemplary "washer" should be construed as any device that can operate in combination with the cable to form a barrier to contain a spring. It is further understood that the term clamp should be construed as any device that can be fixedly secured to the cable.

Figure 5:
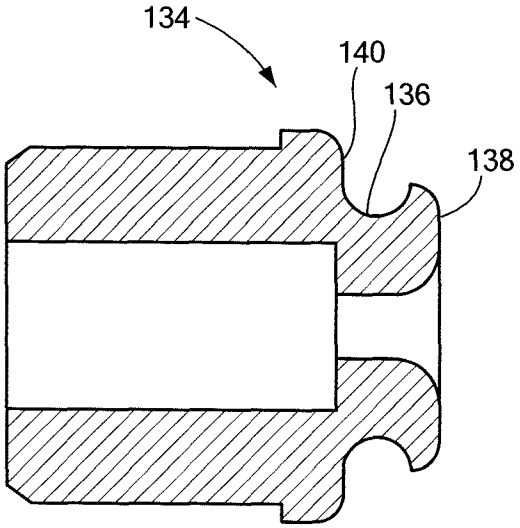
FIG. 5 is a cross sectional view of a connector in the pivot point mechanism.

FIG. 5 shows further detail for the pivot connector 134 of FIG. 4. The post 104 pivots at the pivot point 109 and the configuration of the pivot connector 134 prevents the post from getting locked in the horizontal position. For example, a pivot connector having a generally convex shape can result in lock up of the post.

Figure 6:
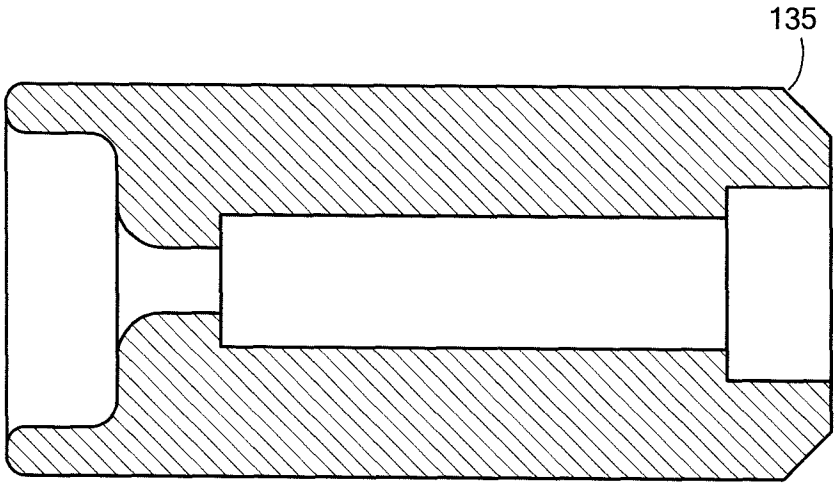
FIG. 6 is a side view of a connector to mate the connector of FIG. 5.

In an exemplary embodiment, the pivot connector 134 includes a groove 136 having a diameter less than a diameter of an end 138 of the pivot connector 134 and less than a mating portion 140 of the pivot connector. This arrangement allows the springs 122, 124 to readily push the post to the vertical position. FIG. 6 shows an exemplary female connector 135 to receive the pivot connector 134.

Figure 7:
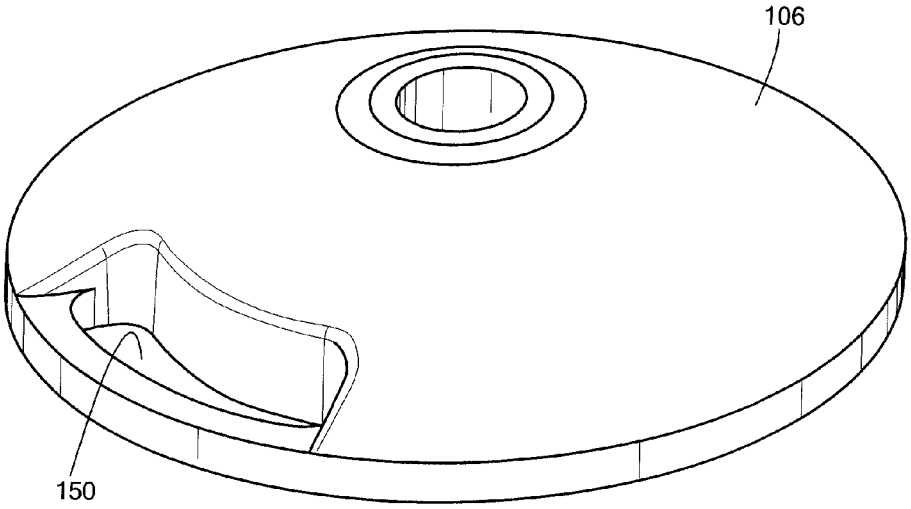
FIG. 7 is a plan view of a base of a batting tee.

FIG. 7 shows an exemplary configuration for the base 106. In the illustrative embodiment, the base has a cutout region 150 to form a handle for carrying the tee. The base can comprise molded rubber or any other suitable material with a weight to counteract spring tension.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A batting tee, comprising:

a ball holder;

a post having first and second ends, the ball holder connected to the first end of the post;

a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder; and a magnet to secure the post to the base.

2. The tee according to claim 1, wherein the first spring comprises a compression spring.

3. The tee according to claim 1, further including a first spring barrier coupled to the cable to contain the first spring in a first cavity and a second spring barrier coupled to the cable to contain the second spring in a second cavity.

4. The tee according to claim 1, wherein the first spring barrier comprises a washer.

5. The tee according to claim 1, further including a first clamp secured to the cable proximate the first spring barrier and a second clamp secured to the cable proximate the second spring barrier.

6. The tee according to claim 1, wherein the pivot mechanism comprises a connector shaped to increase a distance between the first and second cavities as the post flexes at the pivot point.

7. The tee according to claim 6, wherein the connector is shaped to prevent the post from being locked in a flexed position.

8. The tee according to claim 7, wherein the connector comprises a groove to prevent the post from being locked in the flexed position.

9. A batting tee, comprising:

a ball holder;

a post having first and second ends, the ball holder connected to the first end of the post;

a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder; and a magnet contained in the post and a ferromagnetic material in the base to removably secure the post to the base.

10. A batting tee, comprising:

a post having first and second ends, a ball holder connected to the first end of the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder;

a base removably matable to the post; and a magnet proximate the second end of the post to secure the post to the base.

11. The tee according to claim 10, wherein the first spring comprises a compression spring.

12. The tee according to claim 10, further including a first spring barrier coupled to the cable to contain the first spring in a first cavity and a second spring barrier coupled to the cable to contain the second spring in a second cavity.

13. The tee according to claim 10, wherein the pivot mechanism comprises a connector shaped to increase a distance between the first and second cavities as the post flexes at the pivot point.

14. The tee according to claim 10, wherein the pivot point mechanism comprises a connector that includes a groove to prevent the post from being locked in the flexed position.

15. The tee according to claim 10, further including a ferromagnetic material in the base to removably secure the post to the base.

16. A method, comprising:

employing a post having first and second ends;

connecting a ball holder to the first end of the post;

employing a base removably matable to the post, wherein the post includes a pivot mechanism proximate the second end of the post, the pivot mechanism including a pivot point located between axially aligned first and second springs connected to a cable extending along a coincident longitudinal axis of the first and second springs, the pivot point to allow the post to rotate at the pivot point in response to an impact on the ball holder and/or post; and employing a magnet to secure the post to the base.

17. The method according to claim 16, further including coupling a first spring barrier to the cable for containing the first spring in a first cavity and coupling a second spring barrier to the cable for containing the second spring in a second cavity.

18. The method according to claim 16, wherein the pivot mechanism includes a connector with a groove to prevent the post from being locked in the flexed position.

* * * * *